United States Patent [19]

Conte

[11] Patent Number: 4,852,729

[45] Date of Patent: Aug. 1, 1989

[54] CIGARETTE-LIGHTER HOLDER

[76] Inventor: John R. Conte, 843 W. 15th St., Newport Beach, Calif. 92663

[21] Appl. No.: 162,559

[22] Filed: Mar. 1, 1988

[51] Int. Cl.[4] ..... B65D 85/10; B65D 85/20

[52] U.S. Cl. ..... 206/86; 206/87; 206/236; 206/259

[58] Field of Search ..... 206/85–89, 206/259, 236

[56] References Cited

U.S. PATENT DOCUMENTS

| | | | |
|---|---|---|---|
| D. 166,178 | 3/1952 | D'Orsay | 206/89 |
| 1,722,967 | 10/1929 | Russell | 206/87 |
| 1,845,340 | 2/1932 | Ritzwoller | 206/89 |
| 1,846,275 | 2/1932 | Palanjian | 206/87 |
| 2,057,453 | 10/1936 | Siebert | 206/259 |
| 2,420,031 | 5/1947 | Cohn | 206/259 |
| 2,460,427 | 2/1949 | Musselman et al. | 206/89 |
| 4,000,812 | 1/1977 | Pisarski et al. | 206/87 |
| 4,190,148 | 2/1980 | Schade, II et al. | 206/89 |
| 4,588,076 | 5/1986 | Caputo et al. | 206/86 |

FOREIGN PATENT DOCUMENTS

| | | | |
|---|---|---|---|
| 1292446 | 3/1962 | France | 206/87 |
| 0014224 | of 1913 | United Kingdom | 206/259 |

*Primary Examiner*—Jimmy G. Foster

*Attorney, Agent, or Firm*—Laff, Whitesel, Conte & Saret

[57] ABSTRACT

A holder for a cigarette pack and a lighter. The holder includes two compartments and has an open top. The holder is integrally formed as a one piece, five-sided plastic box. A partition is integrally joined with three sides and separates the compartments. Within the lighter compartment is inserted a depth adjusting block which adjusts the height of the lighter. A different embodiment is made with a lighter compartment which is formed shallower than compartment for the cigarette pack.

4 Claims, 2 Drawing Sheets

CIGARETTE-LIGHTER HOLDER

The present invention relates to a combination cigarette and lighter holder. More particularly, the invention relates to a combination holder which holds both a package of cigarettes, and a cigarette lighter of the disposable butane type.

All cigarette smokers encounter the frustrating problem of reaching for a cigarette only to find that they do not have a lighter to light the cigarette with. Either the lighter is located in another pocket, or is difficult to find in one of their pockets or purse.

Also, due to the ever-increasing costs of cigarettes, smokers are looking for economical lighters to use to light their cigarettes. The readily available butane lighters satisfy this need.

In short, a problem exists for cigarette smokers having ready access to an economical means for lighting their cigarettes. The combination cigarette-lighter holders that are shown in the prior art are inconvenient, relatively expensive, some require special lighters, and have other problems associated with them.

The Pekosky U.S. Pat. No. 4,000,812 shows a holder for carrying a package of cigarettes and a cigarette lighter. The holder has a relatively complex design. It completely encloses the top and bottom of the cigarette package and has a flexible bottom wall that opens and closes so that the cigarettes may be inserted into the housing 21.

U.S. Pat. No. 4,000,812 does not provide an easy manner of inserting the cigarettes into a holder. Also, the design of the holder with the slide top, flexible bottom, open side for the lighter is relatively complex.

U.S. Pat. No. 2,958,416 shows a plastic or leather holder with a top flap that holds a lighter upright when the flap closes the holder. However, if the cover is flipped open, there is a possibility that the lighter will fall which again adds to the frustration of the smoker. Further, it appears that a special lighter would be necessary to fit in the pocket in the flap.

Other means have been provided to overcome the smoker's frustrations. U.S. Pat. No. 4,281,761 places a specially designed cigarette lighter on the top of a flip-top package.

U.S. Pat. No. 4,267,924 or U.S. Pat. No. 3,976,194 show specialized lighters for the cigarettes.

It is desirable therefore, to provide a combination cigarette-lighter holder which is relatively inexpensive, and will hold cigarettes and a readily available lighter, i.e., a butane lighter.

SUMMARY OF THE INVENTION

Accordingly, one of the objects of the present invention is to provide a new and improved reusable combination cigarette-lighter holder which has a compartment sized to hold a conventional cigarette package and a compartment to hold a conventional cigarette lighter.

Still another object of the present invention is to provide a new and improved combination cigarette-lighter holder which does not cover the top of a package of cigarettes and provides the lighter in ready access to the user.

A further object of the present invention is to provide a new and improved combination cigarette lighter holder which is simple in design and economical to manufacture.

In accordance with one embodiment of the present invention, these and other objects are obtained by providing the combination cigarette lighter.

DESCRIPTION OF THE DRAWINGS

A more complete appreciation of the invention and the advantages thereof will be readily appreciated as the same becomes better understood by reference to the following detail description when considered in connection with the accompanying drawings wherein.

DESCRIPTION OF THE PREFERRED EMBODIMENTS

My cigarette-lighter holder is sized to hold a package of cigarettes and a cigarette lighter conveniently with one hand. The holder is preferable molded on one piece of material. The holder is a generally rectangular shaped open top and closed bottom contained. The corners are generally rounded for aesthetic reasons and to allow the holder to be conveniently stored by the user. The open top container is divided into two adjacent compartments by a dividing wall. One compartment is sized to frictionally hold a package of cigarettes therein with the top of the cigarettes extending above the to of the container. The other compartment is sized to frictionally hold a well known regular butane type lighter therein with the top of the lighter extending a predetermined distance above the package of cigarettes. The dividing wall may either be a solid wall or a pair of opposing ribs spaced a predetermined distance apart to engage one face of the lighter. The means to adjust the height of the lighter may be an integral molded base in the lighter compartments, on separate base appropriately attached on the right of the lighter compartment can be made to accommodate the lighter.

The material is preferably flexible and can be elastic if desired. The material is made from rubber, synthetic rubber plastic such as polyvinyl, polyethylene, polypropylene or polyurethane. The material may also be a more rigid molded type plastic. A preferred aspect of my invention is where the material is flexible enough so that it can be folded and easily stored in the user's pocket or purse when not in use. Also, by being flexible it is easier for the manufacturer to package as a promotional item to be sold with the cigarettes. Also, it is a preferred embodiment that the material be sufficiently flexible so that the cigarette package and lighter may be frictionally held in place by the walls of the holder.

Another preferred embodiment is one where my cigarette-lighter holder is made of an elastic type material which is either colored or as an appropriate design on the package. The elastic holder generally has a size that allows the holder to be used for more than one size of cigarette package. Also, if the holder is made from a rubber type composition, the holder has a desirable feel to it. The user can easily grip the holder.

Figure 1:
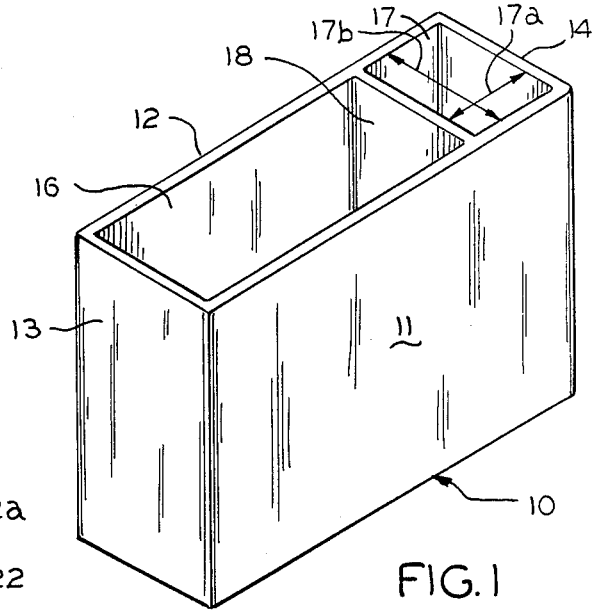
FIG. 1 is a perspective view of the combination cigarette-lighter holder of the present invention.

Now referring to the drawings, and more particularly to FIG. 1, there is shown my cigarette-lighter holder 10 being made of a clear plastic type of material.

The cigarette-lighter holder 10 has a front wall 11, a rear wall 12, left side wall 13 and a right side wall 14.

The front, rear and side walls 13 and 14 have substantially identical heights and are shorter than the package of cigarettes that will be placed in the cigarette-lighter holder. The front and rear walls are substantially identical and interconnect the side walls.

The top of the cigarette-lighter holder is open and the bottom is closed by the wall 15 which interconnects side walls 13 and 14.

The cigarette-lighter holder is divided into two open compartments 16 and 17 by a divider wall 18. The divider wall 18 is substantially the same height as the side walls.

The top surface of the holder when in the configuration shown in FIG. 1 has a top surface that lies in a plane substantially parallel to the bottom wall 15.

Compartment 16 is sized to hold a package of cigarettes. The size of compartment 16 will vary depending upon the size of cigarettes it is intended to hold. We intend to utilize separate cigarette-lighter holders for different size cigarette packages.

The internal size of the container 16 will be slightly smaller than the external size of the cigarette package it is intended to hold. This size differential permits a full package of cigarettes to have a friction fit with compartment. This is especially advantageous with flip-top cigarette packages.

The container compartment 17 is sized to hold a cigarette lighter in frictional engagement. The compartment has a width 17*a* and length 17*b* which are slightly less than the corresponding outer width 22*a* and length 22*b* of a conventional lighter 22. Thus, when the conventional lighter 22 is inserted into the compartment 17, it will be frictionally held in place by the inner walls of the compartment 17.

The common wall 18 may be integral with the walls 11 and 12. Also, the wall 18 may be a non-integral wall and merely fixedly attached to the walls 11 and 12.

Figure 2:
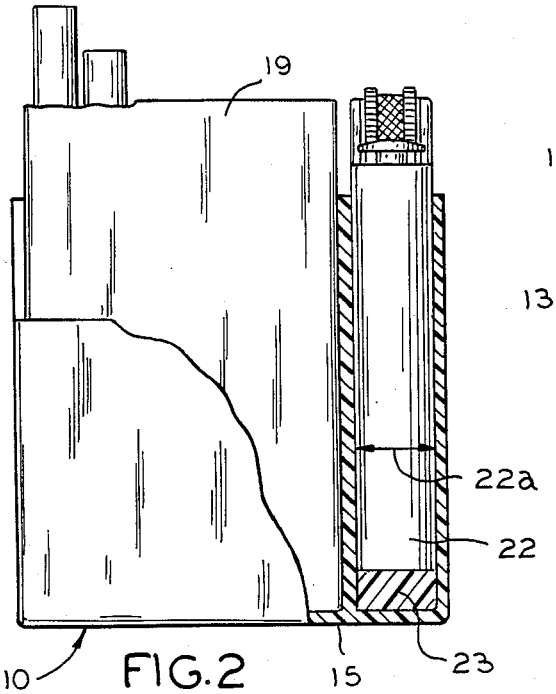
FIG. 2 is a front elevational view of the cigarette-lighter holder of the present invention in partial section showing a package of cigarettes and a conventional lighter in the holder.
Figure 3A:
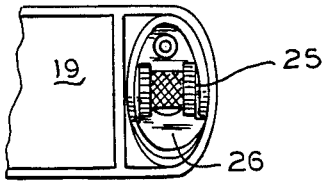
FIG. 3A is a partial top plan view of the cigarette-lighter holder illustrating another embodiment of the present invention.
Figure 3:
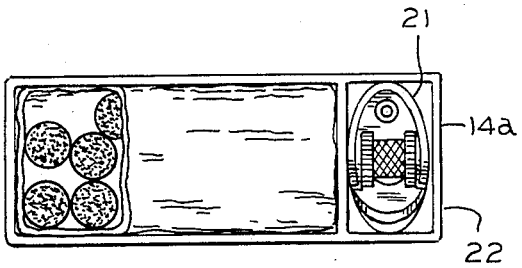
FIG. 3 is a top plan view of the cigarette-lighter holder illustrated in FIG. 2.

When referring to FIGS. 2 and 3, a regular package of cigarettes 19 is placed in my cigarette-lighter holder 10. The cigarette holder 10 in FIGS. 2 and 3 is shown as having flexible, but not collapsible walls 12, 13 and 14. However, as stated above, when the material used to make the cigarette-lighter holder 10 is totally flexible such as a non-rigid sheet-type polyethylene or polyvinyl type of material is used, the size of the compartment 17 will be substantially smaller so that the wall portions 14*a* 12 (FIG. 3*a*) of compartment 17*c* will hug or come in total contact with the outer surface 21 of the lighter 22.

In this embodiment it is preferred that the divider wall 18 is not of the sheet type and is some what stiff or rigid to maintain its shape. However, if desired, the entire cigarette-lighter holder may be made from flexible sheet-type plastic and be completely foldable. In that instance, the compartment would completely conform to the shape of the lighter.

The lighter 22 dimension 22(*b*) normally is similar to or at least closely approximating the width of a package of cigarettes. However, this is not necessary for our present invention. Presently, most disposable butane lighters are only slightly smaller or slightly larger than the width of the cigarette package.

The height of our cigarette-lighter holder 10 is a predetermined distance shorter than the height of the cigarette package it is intended to hold. The height will be determined as to whether or not the cigarettes are king-size, regular size, or flip-top boxes. In the case of a flip-top box, the height of the cigarette-lighter holder should not be higher than the front opening line of the flip-top box.

It is preferred that the height of the cigarette-lighter holder be more than half the height of the cigarette package it is holding.

The cigarette lighter 22 is of a set size. Therefore, to accommodate various cigarette-lighter holder lengths, or size of cigarettes, the cigarette-lighter holder has at the bottom of its lighter compartment, an adjusting block 23 which is made out of any suitable material. Preferably, the adjustable height block is made from the same type of material, or similar type of material so that it is easily fastened or affixed to the bottom of the lighter compartment.

The block adjusts the lighter so that the top 24 of the cigarette package 19 is about the mid point of the flint wheel 25 and slightly above the butane release button 26. Preferably, the cigarette lighter is to be 1/16 to ½″ above the height of the cigarette package.

Also, the height of the walls 14 should be below the flame adjusting knob 27. So that, the flame 28 as shown in FIG. 5 will be above the top of the cigarette package.

Figure 5:
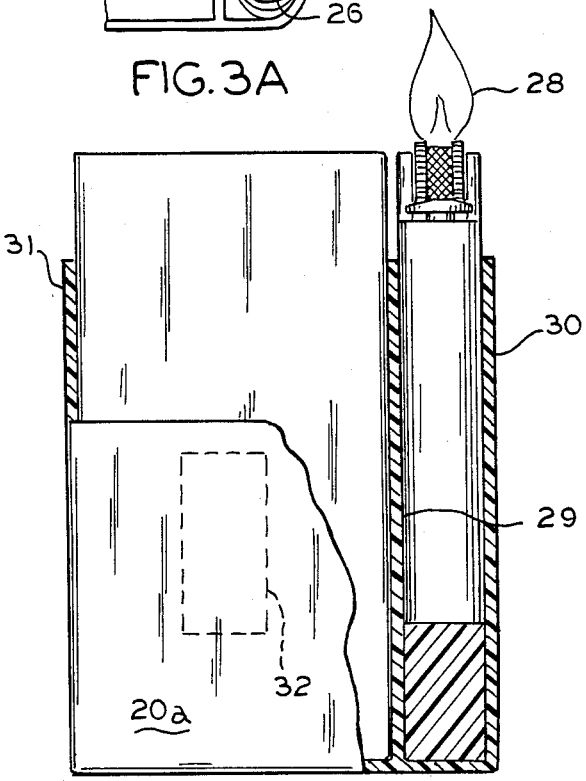
FIG. 5 is a front elevational view with a partial section of the cigarette-lighter holder showing another embodiment of the present invention.
Figure 4:
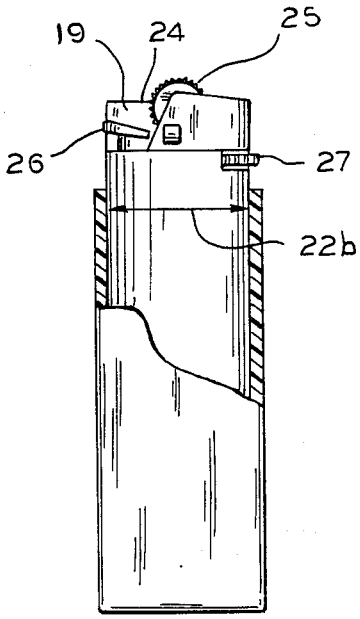
FIG. 4 is a side elevational view of the cigarette-lighter holder of FIG. 2 with a partial section thereof.
Figure 6:
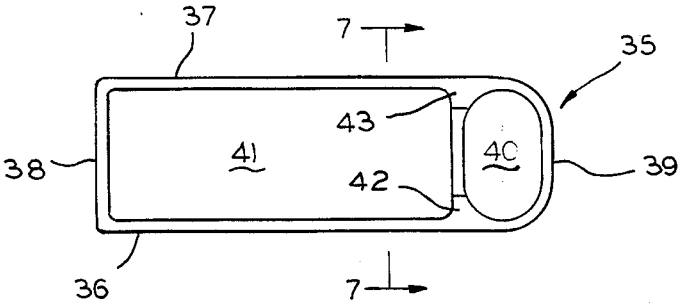
FIG. 6 is a top view of another embodiment of the present invention.
Figure 7:
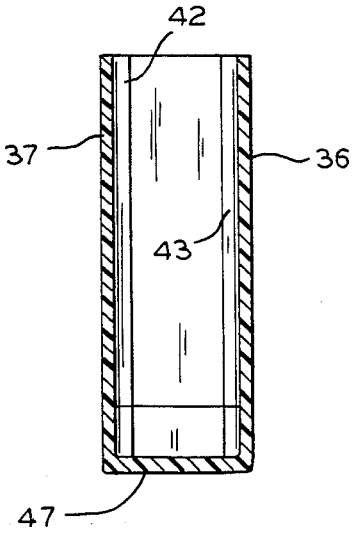
FIG. 7 is a side sectional view taken along lines 7—7 of FIG. 6.
Figure 8:
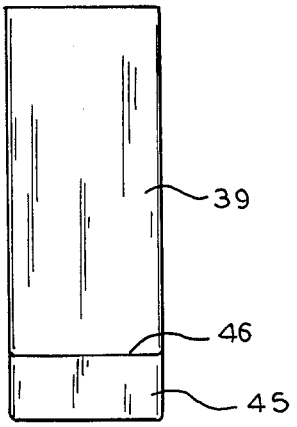
FIG. 8 is a right side sectional view of FIG. 6.

In the embodiment shown in FIG. 5, there is shown another combination cigarette-lighter holder 20A having a compartment dividing wall 29 which has a lesser height than the outside wall 30 and 31. The dimension of the inside wall 29 is such that it contacts more than half of the length of the lighter body.

In FIG. 5, I show an alternative embodiment. In dotted lines a fastening mechanism 32 which may be a Velcro type attachment is affixed to the holder. A Velcro strip on the cigarette-lighter holder allows the holder to be easily attached to a car sun visor or other places where the user may desire to store his cigarettes. Since the lighter and cigarettes are frictionally held within the holder, the user is provided with a convenient and accessible place to store his cigarettes.

FIGS. 6–9 show still another embodiment of my invention. The cigarette-lighter holder 35 has a front wall 36, rear wall 37, left side wall 38 and right side wall 39.

The left side wall 38 extends the length of the cigarette-lighter holder 35. The right side wall only extends a portion of the cigarette-lighter holder length. The length of the side wall 39 is determined by the length of the lighter to be held by lighter compartment 40.

Lighter compartment 40 is shown to hold a lighter that has a generally rectangular shape with rounded ends. The outer surface of the lighter (not shown) will contact all the walls of the lighter compartment 40.

The cigarette compartment 41 has a shape and dimension to hold a desired package of cigarettes.

The two compartments are divided from each other by ribs 42 and 43 extending the length of the lighter compartment 40. The ribs extend a sufficient distance towards each other from their respective front and rear walls 36 and 37 to form an open wall to hold the lighter in lighter compartment 40.

Figure 9:
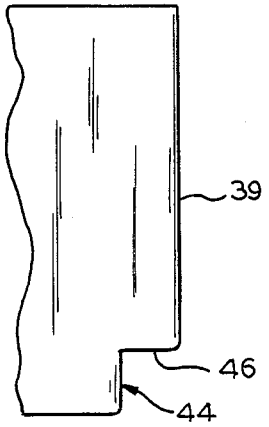
FIG. 9 is a partial front elevational view of FIG. 6.

The front and rear walls 36 and 37 form step portion 44 as shown in FIG. 9. This step portion 44 has a connecting wall 45 which connected the front and rear walls below the lighter compartment 40. Also, the step portion 44 has a lighter compartment bottom wall 46 extending substantially perpendicular to the wall 45 and connecting the wall 45 with the wall 39.

The wall 45 extends substantially perpendicular from the cigarette chamber bottom wall 47.

Portions of the embodiment shown in FIG. 6–9, of course, can be adapted to any of the other embodiments. For instance, the dividing walls 18 and 29 can be substituted with ribs 42 and 43. Where an oval lighter is used, the ribs may contact the oval ends of an oval lighter with a portion of a side of the lighter extending into the cigarette package compartment 16.

The configuration of the cigarette-lighter holder 35 has the lighter compartment shaped to eliminate the need for the lighter adapter 23. Of course, if it is desired, the cigarette compartment 40 can be sized as shown in FIGS. 2 and 5 with an adapter or vice versa. The cigarette compartment of FIGS. 2 and 5 can be shaped as that of FIGS. 6–9 to eliminate the need of an adapter.

It can be seen that with the present invention, a conventional cigarette package is inserted into the compartment 16 of the cigarette-lighter holder 10 with the bottom of the cigarette package 19 touching the bottom inner surface of the bottom wall 15. The cigarette package is slightly larger than the compartment 16 and thus the package is frictionally held by the walls of the compartment 16. In this manner, it is possible to carry the cigarette-lighter holder with the cigarettes therein without having the cigarettes jarring loose from the holder.

A conventional butane lighter 22 is placed in the lighter compartment 17. The lighter compartment is sized such that the frictional force placed on the lighter 22 by the compartment walls is sufficient to hold the lighter in frictional engagement so that the lighter will not jar loose from the cigarette-lighter holder.

When the smoker desires to have a cigarette, he merely reaches for his cigarettes which are in my cigarette-lighter holder. He now picks up both the cigarette lighter and the cigarettes. The cigarette-lighter holder with the cigarettes and lighter are held in one hand, a cigarette is removed with the other hand and with the same hand holding the holder, the lighter can be operated in its normal fashion using a thumb.

This one-hand ease of operation renders our cigarette-lighter holder very convenient. Also, due to our relatively simple design, the manufacturing of the cigarette-lighter holder can be done at a relatively inexpensive cost.

I claim:

1. A holder for cigarettes and a lighter, said holder comprising a one piece five sides plastic box with the top of the box open, an internal partition wall integrally formed within said box, said partition wall being integrally joined with three of said five sides and parallel to the other two of said five sides thereby forming said box into first and second compartments, said box having a height which is sufficiently less than the height of a regular pack of cigarettes so that a person may grip the top of the pack for pulling it from or inserting it into said box and so that packs of different lengths may be inserted into said box, said first compartment in said box and on one side of said partition wall having an internal length and width which receives the bottom of a pack of cigarettes with a friction fit adequate to prevent accidental separation of the pack and box while enabling an easy insertion or removal of said pack from said box, said second compartment in said box and on an opposite side of said partition wall having an internal length and width which receives the bottom of a lighter which is no wider than the width of said pack of cigarettes, a length and width of said second compartment receiving said lighter with a snug fit to prevent accidental separation of said lighter from said box while enabling an intentional insertion or removal of said lighter from said box, and means for deposit in the bottom of said second compartment for limiting the depth of said second compartment, said limiting means adjusting the depth of said second compartment so that the top of a lighter is no lower than the top of said pack of cigarettes when in said box.

2. The holder of claim 1 and a plurality of said limiting means for adjusting the height of a lighter to match the height of said lighter to match the height of said pack of cigarettes.

3. The holder of claim 2 wherein the top of said lighter is in the range of 1/16 to ½-inch above the top of said pack of cigarettes.

4. The holder of claim 1 and one side of a Velcro fastener for attaching said holder to another object.

* * * * *